US006604498B2

(12) United States Patent
Fernandez et al.

(10) Patent No.: US 6,604,498 B2
(45) **Date of Patent: *Aug. 12, 2003**

(54) ACTUATION MECHANISM FOR MODE-SWITCHING ROLLER FINGER FOLLOWER

(75) Inventors: Hermes A. Fernandez, Rochester, NY (US); Ryan D. Fogarty, West Henrietta, NY (US); Jongmin Lee, Pittsford, NY (US); Wayne S. Harris, Hilton, NY (US); Michael E. McCarroll, West Henrietta, NY (US); Nick J. Hendriksma, SE Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 66 days.

This patent is subject to a terminal disclaimer.

(21) Appl. No.: 09/829,738

(22) Filed: Apr. 10, 2001

(65) Prior Publication Data

US 2001/0035140 A1 Nov. 1, 2001

Related U.S. Application Data

(60) Provisional application No. 60/204,622, filed on May 16, 2000.

(51) Int. Cl.[7] ..... F01L 1/34

(52) U.S. Cl. ..... 123/90.16; 123/198 F; 123/90.39

(58) Field of Search ..... 123/90.16, 198 F, 123/90.39, 90.4, 90.41, 90.42, 90.44, 90.45, 90.46, 90.47

(56) References Cited

U.S. PATENT DOCUMENTS 5,669,342 A * 9/1997 Speil ..... 123/198 F

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A system for selectively switching the action of a valve in an internal combustion engine includes a roller finger follower having a frame and a disengageable roller. A two-part axial pin for the roller axle is spring-loaded to urge the pin axially of the roller axle to disengage the first part of the pin from the follower frame and simultaneously disengage the second part of the pin from the roller axle. Thus the roller becomes detached from the frame and the follower cannot actuate its designated valve. The roller and pins are retained within the frame by at least one torsion spring. The pins may be controllably reinserted into the sides of the roller and frame to reconnect the roller to the frame by any of various electromechanical and/or hydraulic means. When used in conjunction with a camshaft having high lift and low lift cam lobes, the deactivated follower will then actuate its designated valve according to the profile of the low lift lobes, which may be a no lift profile.

14 Claims, 7 Drawing Sheets

ACTUATION MECHANISM FOR MODE-SWITCHING ROLLER FINGER FOLLOWER

CROSS-REFERENCE OF RELATED APPLICATIONS

This application claims the benefit of U.S. Provisional Application Ser. No. 60/204,622 filed May 16, 2000.

TECHNICAL FIELD

The present invention relates to actuation mechanisms for mode-switching and deactivation of valves in internal combustion engines; more particularly, to such actuation mechanisms including a roller finger follower in the valve train of such an engine; and most particularly, to a system for controllably inserting and releasing an axial pin assembly in such a follower to alternately enable and prevent the roller from translating the eccentricity of a camshaft lobe into reciprocating motion of an engine valve. Such a system also may be adapted for selective switching between a low lift cam profile useful for low engine speeds and a high lift cam profile useful for high engine speeds. The low lift mode may include zero lift of the valve, i.e., deactivation thereof.

BACKGROUND OF THE INVENTION

It is known to improve the fuel efficiency of multi-cylinder internal combustion engines by controllably reducing the number of combustive cylinders during periods of low power demand. Systems are known, for example, for interrupting the action of an engine's valve train at one or more points in the engine's rotary cycle. Valve train interruption or modulation is especially desirable because it can cause the valves of the designated cylinder or cylinders to remain closed and thus can prevent consumption of fuel by those cylinders. The valve train may be controllably interrupted, for example, by known variable mechanisms linking the camshafts to their associated roller finger followers. See, for example, the relevant disclosures of U.S. Pat. Nos. 5,937,809 and 6,019,076.

It is known that low lift, short duration cam profiles are capable of delivering good low rpm drivability, fuel economy, and emissions. High lift, long duration cam profiles are capable of providing improved engine breathing at higher engine speeds for increased power output. A valve in a valve train may be controllably switched between low lift and high lift profiles.

All such mechanisms require input from specialized sensors in the valve train to sense, for example, the angular position of a camshaft at any given moment, and sensors to sense the rotational speed of the engine. These and other inputs are provided to an Engine Control Module (ECM) programmed to respond by modulating the action of, and in the extreme deactivating or reactivating, the valves of pre-selected cylinders. For simply deactivating valves, such an approach can be quite complex and expensive to fabricate and install.

Another approach for interrupting the valve train is by use of special deactivatable lifters which can be made hydraulically compliant or non-compliant as desired. Such an approach can require complex and expensive hydraulic and electrical circuitry and controls.

What is needed is a simple and inexpensive means for interrupting a valve train between a camshaft lobe and a roller finger follower.

A related need is for a simple and inexpensive means for mode-switching a valve train between high lift and low lift valve actuation.

SUMMARY OF THE INVENTION

Briefly described, a mode-switching valve train system in accordance with the invention includes a specialized roller finger follower having a frame and a roller disposed operationally between a camshaft lobe and a valve stem, the follower being tethered conventionally by lash adjustment means at an end opposite the engagement point with the valve stem. A two-part axial pin for the roller is spring-loaded to urge the pin axially of the roller such that the first part of the pin is withdrawn from engagement with the follower frame and simultaneously the second part of the pin is withdrawn from the roller into an opposite side of the frame. Thus the roller becomes detached from the frame and, in following the profile of the camshaft during rotation thereof, cannot cause the frame to actuate its designated valve; thus, the valve is deactivated. When the above-described camshaft lobe is a central high lift lobe and the camshaft is additionally provided with low lift cam lobes adjacent the central lobe, the low lift lobes may engage the frame when the roller is deactivated, causing the valve to follow the profile of the low lift lobes. Thus, a roller finger follower in accordance with the invention may be used for selectively switching between valve activation and deactivation and also for selectively switching between high lift and low lift valve opening modes.

Preferably, the roller and pins are retained within the frame by at least one torsion spring. The two-part pin may be controllably reinserted into the sides of the roller and frame to reconnect the roller to the frame by the axial motion of any of various electromechanical and/or hydraulic means which may be disposed on-axis or off-axis of the two-part pin and roller.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Benefits and advantages of a mode switching valve train system including a roller finger follower in accordance with the invention may be better appreciated by first considering a prior art roller finger follower.

Figure 1:
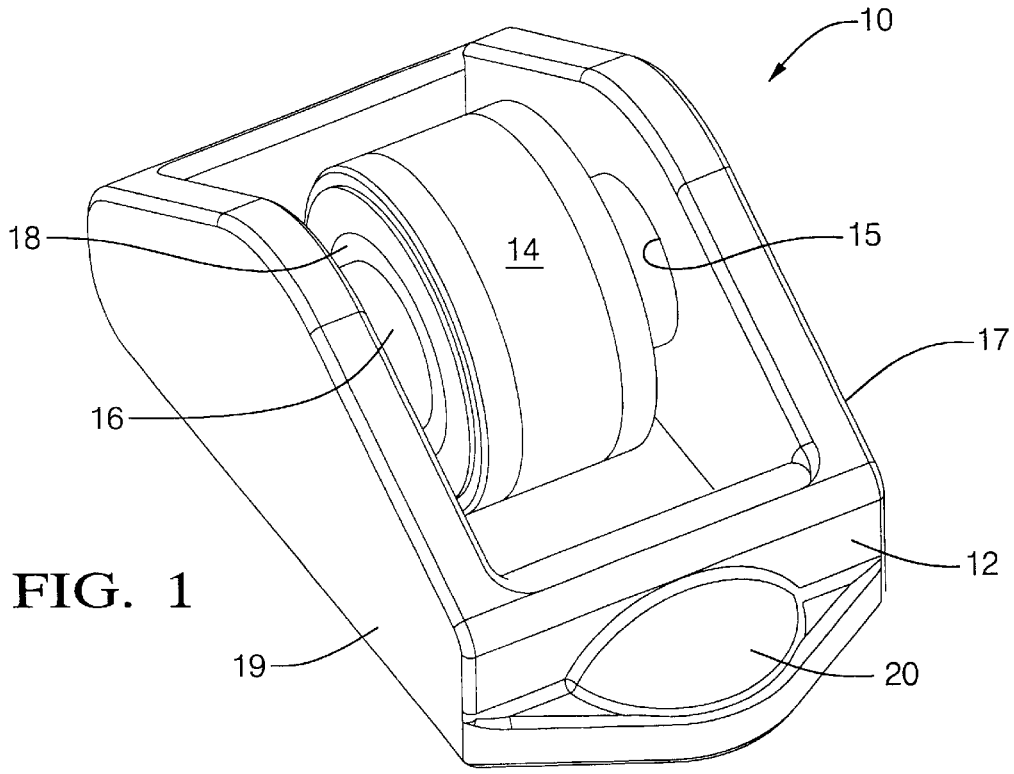
FIG. 1 is an isometric view from above of a prior art roller finger follower.

FIG. 1 shows a prior art roller finger follower 10 for translating the rotary motion of a camshaft lobe into reciprocating motion of a valve. The construction and disposition of follower 10 in an internal combustion engine is well known in the automotive art and thus is not described herein in detail except as needed to distinguish novel differences between a prior art follower and an improved follower in accordance with the invention. Follower 10 includes a frame 12 and a roller 14 rotatably disposed on an axial pin 16 fixed at opposite ends in bores 15 in sidewalls 17,19 of frame 12. Typically, roller 14 is provided with a bearing 18 which may be a journal bushing or a roller or needle bearing. Frame 12 has a first socket formed on an underside thereof, the dome 20 of which is visible in FIG. 1, for pivotably receiving a conventional lash adjustment means (not shown) by which follower 10 is tethered to an engine. Frame 12 further has a pallet formed on the underside thereof (not shown) at an opposite end of frame 12 from dome 20 for receiving valve actuation means, for example, the stem of an engine valve (also not shown). In operation, the lash adjustment means urges roller 14 into constant contact with ("follows") a camshaft lobe (not shown) during rotation thereof by engine driving means. As the eccentric valve-opening portion of the lobe passes over roller 14, the follower 10 is caused to pivot on the lash adjustment means away from the cam axis, thus depressing the valve lifter and opening the valve. Similarly, as the eccentric valve-closing portion of the lobe passes over roller 14, the follower 10 is caused to pivot on the lash adjustment means toward the cam axis, thus allowing the valve to be closed by a valve spring (not shown).

Figure 2:
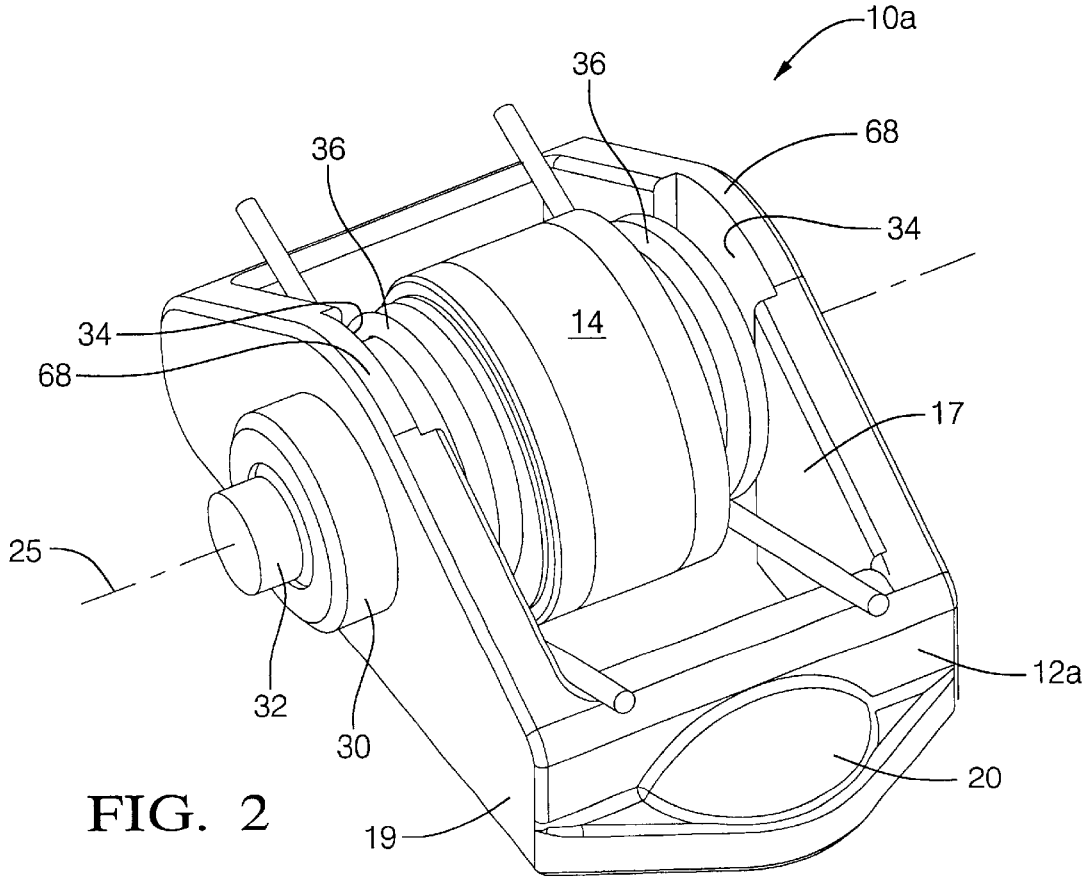
FIG. 2 is an isometric view from above of an improved roller finger follower in accordance with the invention.
Figure 3:
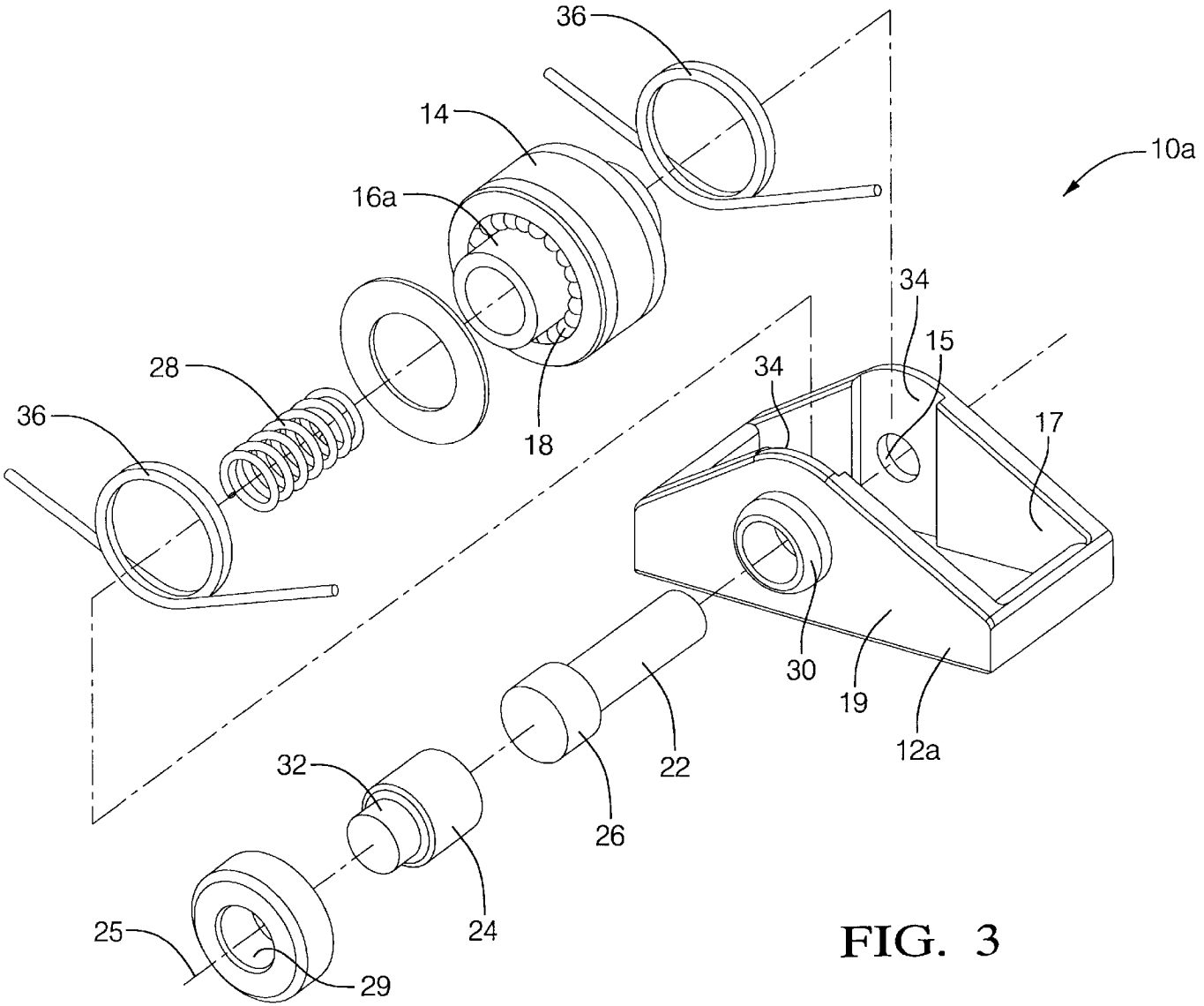
FIG. 3 is an exploded view of the roller finger follower shown in FIG. 2.

Referring to FIGS. 2 and 3, an improved mode switching roller finger follower 10*a* is similar to prior art follower 10 in general shape and disposition within an engine, with the following novel improvements.

Axial pin 16 is replaced with a hollow axle 16*a* rotatably supported by bearing 18 and housing a two-part axial pin assembly 22,24. First pin 22 is disposed within axle 16*a* for detachably engaging bore 15 to rotatably support roller 14 at a first end. Pin 22 is provided with an enlarged portion 26 for engaging and retaining a coil spring 28 in compression between portion 26 and a feature within axle 16*a*, which spring urges pin 22 away from sidewall 17 and, when permitted, into disengagement from bore 15. Shouldered second pin 24 is matably and coaxially disposed against portion 26 of pin 22 and is thereby urged by spring 28 into a shouldered retainer 29 in a boss 30 which is affixed to the side of frame 12*a* coaxially with bore 15 along axis 25. An outer portion 32 of pin 24 extends through retainer 29 as an axial trigger for activating and deactivating follower 10*a*.

In operation, when trigger 32 is depressed into boss 30, follower 10*a* is activated. Pin 24 is extended into axle 16*a* and in becoming so extended forces pin 22 into bore 15 and compresses spring 28. Thus, roller 14 is rotatably supported on both sidewalls 17,19, and follower 10*a* can function exactly as does prior art follower 10.

When permitted as described below, by removal of axial compressive force against trigger 32, spring 28 forces pins 22,24 away from bore 15 until the shoulder on pin 24 engages the shoulder in retainer 29 which acts as a stop. The lengths of pins 22,24 are selected such that the interior end of pin 24 clears the end of axle 16*a* as the opposite end of pin 22 clears bore 15, thus releasing both ends of axle 16*a* and roller 14 from support by frame 12*a*. Pin 22 is retained within axle 16*a* and cannot engage either bore in sidewalls 17,19. Preferably, tracks are formed, comprising channels 34, for axle 16*a* and the bearing and roller in radial excursions away from axis 25. Mode switching follower 10*a* is further provided with at least one, and preferably two, torsion springs 36 disposed coaxially on axle 16*a* and torsionally engaged with frame 12*a*.

In operation, when the roller is disengaged from the frame, as just described, the roller and pins are free to float in channels 34. As the valve-opening portion of the cam lobe rotates past roller 14, the roller and pins, following the lobe, are displaced along channels 34 away from axis 25, compressing springs 36. As the valve-closing portion of the cam lobe rotates past roller 14, the roller and pins are returned along channels 34 by springs 36. Thus the improved roller finger follower 10*a* is decoupled from the center cam lobe by the extension of trigger 32, frame 12*a* does not follow the surface motion of the cam lobe, and the associated valve remains closed. When the camshaft is also provided with outer cam lobes (not shown), the outer lobes may ride on the top surfaces 66,68 of sidewalls 17,19 respectively, and roller finger follower 10*a* will thus follow the profiles of the outer cam lobes. See, for example, camshaft lobes 13 and 15 in FIG. 1 of U.S. Pat. No. 5,697,333, the relevant disclosure of which is herein incorporated by reference.

For the purpose of disclosing actuator function in accordance with the invention, a cylinder valve deactivation application is herein discussed, although it should be understood that such actuation systems may similarly be used in a cam profile switching valve train.

Figure 4:
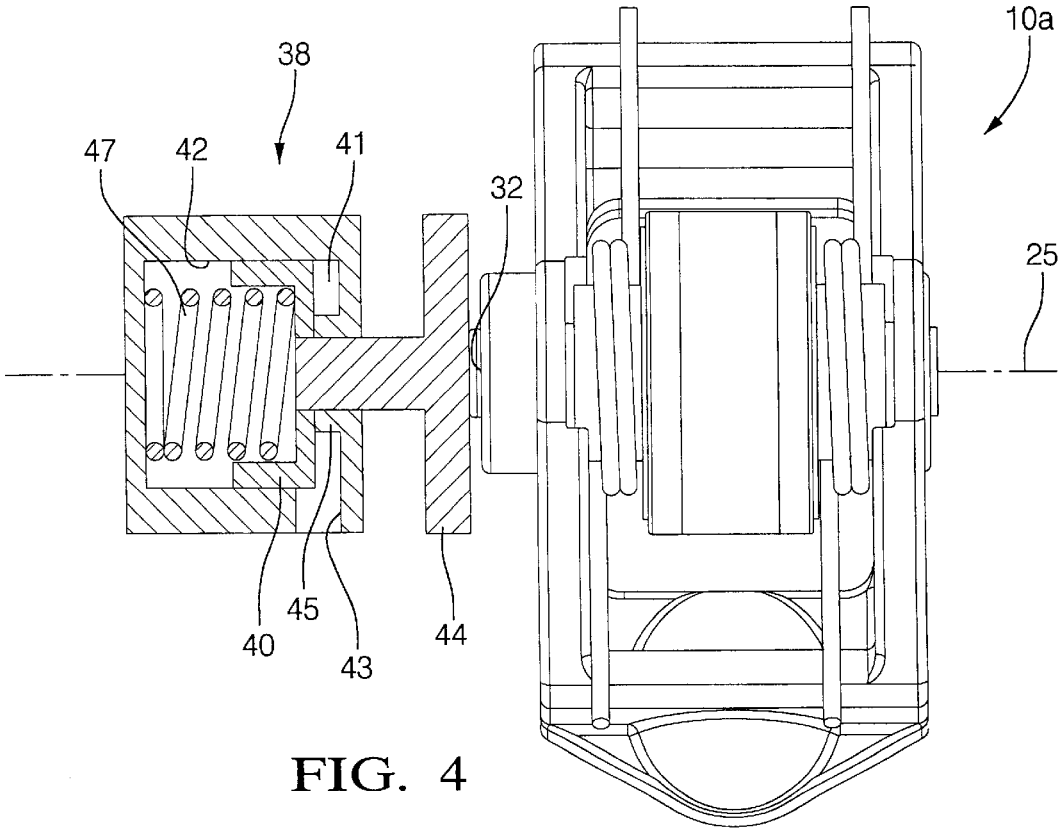
FIG. 4 is a plan view of the roller finger follower shown in FIGS. 2 and 3, showing in cross-sectional view a hydraulic actuator for on-axis actuation of the roller finger follower.
Figure 5:
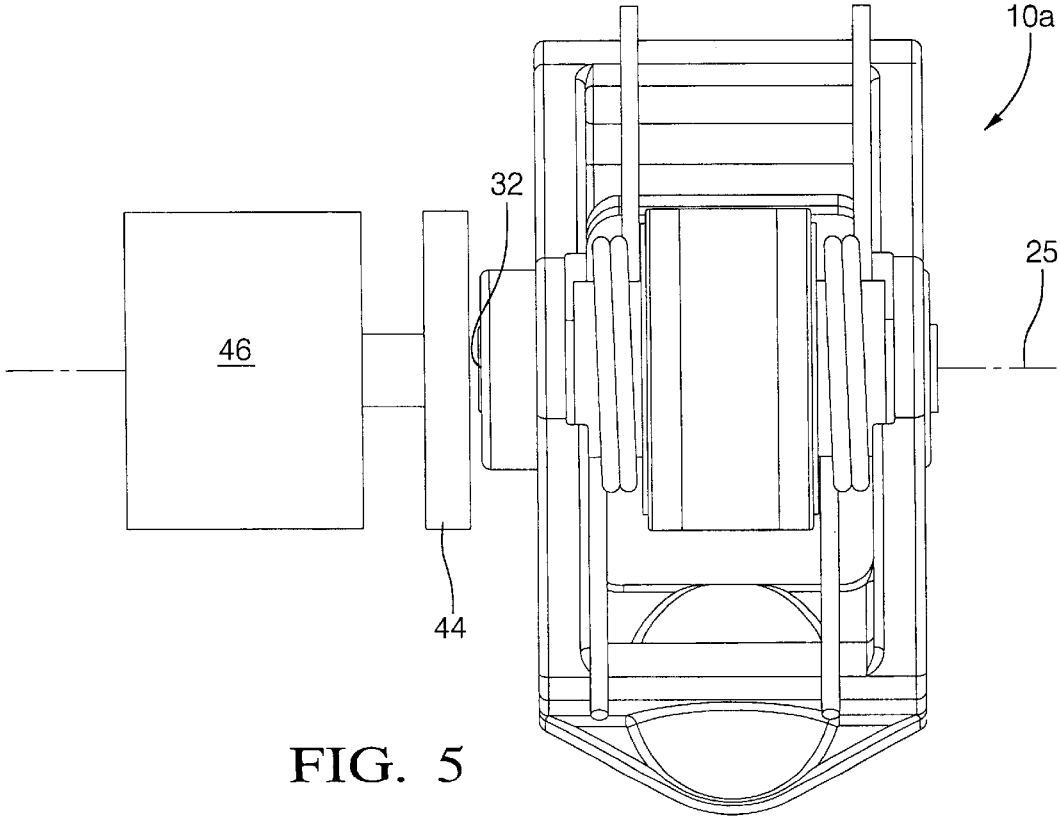
FIG. 5 is a view like that shown in FIG. 4, showing schematically a solenoid for electromechanical on-axis actuation of the roller finger follower.

Trigger 32 may be actuated by any convenient axial-force-imposing means in response to a signal from an ECM in known fashion. Such a signal may be translated into an hydraulic or an electromechanical response. Referring to FIGS. 4 and 5, a linear actuator may be readily mounted on the engine adjacent to follower 10*a* to deliver axial force against trigger 32. Such an actuator may be a hydraulic actuator 38, for example, as shown in FIG. 4, having a piston 40 operable within a cylinder 42 and attached to an actuation plate 44 for mating with trigger 32. Hydraulic actuator 38 is configured such that pressurized oil may enter an annular chamber 41 through a supply port 43. The force exerted by the pressurized oil on piston 40 causes the piston to translate against the force of spring 47. Such translation causes actuation plate 44 to be translated away from trigger 32, allowing the roller to become detached from the frame of the switchable roller finger follower. When the supply of pressurized oil is removed, spring 47 exerts a force on piston 40 causing the piston to translate within cylinder 42, thereby forcing the oil in chamber 41 to evacuate through supply port 43. Piston 40 may translate until it is stopped by the surface of boss 45.

Alternatively, a conventional electromechanical solenoid 46 may be used as an actuator, as shown in FIG. 5. In either case, it is preferable that the actuator be provided with a return spring 47 having greater compressive force than spring 28 within follower 10*a* so that the fail-safe and engine-off position of the follower is in the valve-activating position with trigger 32 depressed, as shown in FIGS. 4 and 5. Thus the deactivating stroke of the actuator is in a direction away from the follower, allowing the follower to spontaneously become deactivated itself.

In some engine applications, steric hindrance arises when the actuator is located coaxially on axis 25, as shown in FIGS. 4 and 5, in that access to the bolts or studs securing the engine head to the engine block is impaired. This can present a significant problem in engine manufacture, where it is desirable to have the head fully assembled before attachment to the block. In such applications, off-axis actuation may be preferable.

Figure 6:
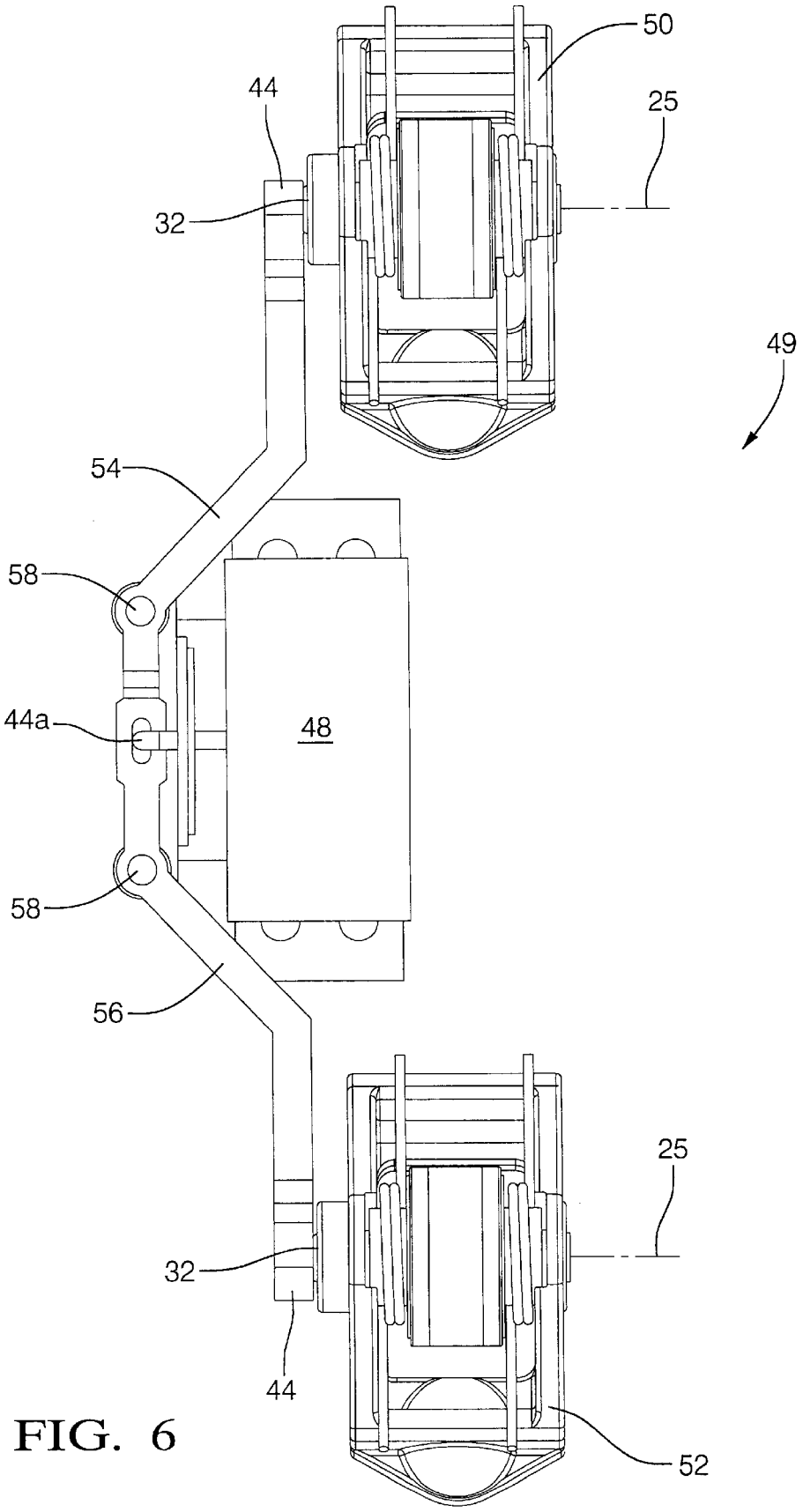
FIG. 6 is a plan view of an off-axis actuator, which may be either hydraulic or electromechanical, coupled by pivot arms to both an intake valve follower and an exhaust valve follower for a single cylinder, for simultaneous actuation thereof.

Referring to FIG. 6, a novel off-axis actuation system 49 is shown. A linear actuator 48, which may be hydraulic or electromechanical, is disposed generally centrally of an engine head (not shown) between an intake valve follower 50 and an exhaust valve follower 52 for the same engine cylinder. Pivot arms 54,56 are provided with actuation plates 44 for engaging triggers 32 and are mounted on fixed pivot shafts 58 and are pivotably attached to an actuation shaft 44*a* extending from actuator 48. A spring similar to spring 47, as shown in FIG. 4 and described for actuators 38 and 46, is incorporated in actuator 48, either internally or externally, to bias arms 54 toward the followers so that they are activated to the default position. When shaft 44*a* is retracted by energizing of actuator 48, arms 54 and 56 are simultaneously pivoted about pivot shafts 58, releasing triggers 32 on followers 50 and 52, as shown in FIG. 7, thereby deactivating the followers and their associated valves.

Figure 6A:
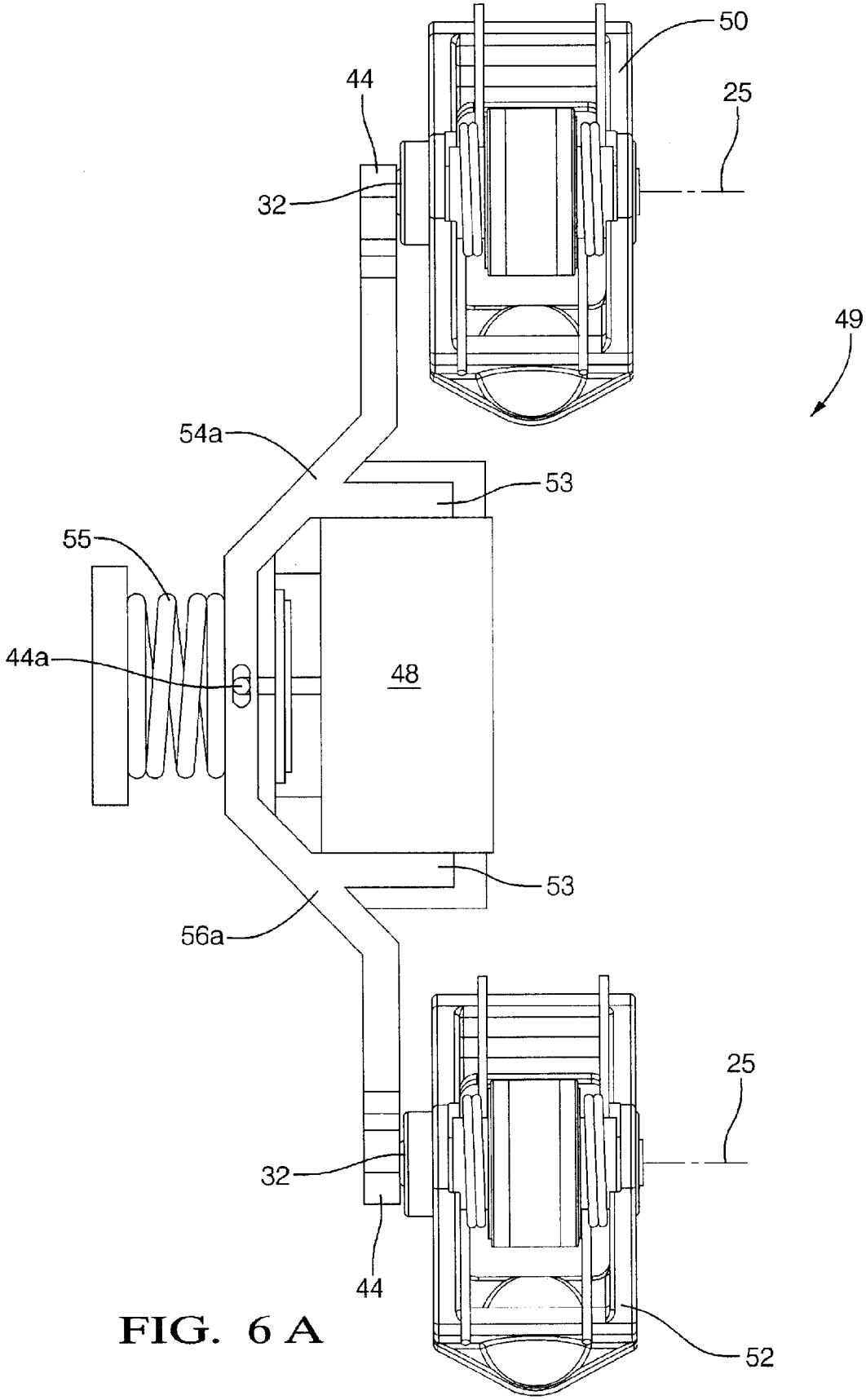
FIG. 6*a* is a plan view like that shown in FIG. 6 of an off-axis actuator coupled by non-pivoting arms for simultaneous direct actuation of intake and exhaust valve followers.

Referring to FIG. 6*a*, another off-axis actuation system 51 is shown. As in FIG. 6, linear actuator 48 is disposed generally centrally of an engine head (not shown) between an intake valve follower 50 and an exhaust valve follower 52 for the same engine cylinder. Like arms 54,56, arms 54*a*,56*a* are provided with actuation plates 44 for engaging triggers 32 but are not mounted on fixed pivot shafts and are not pivotably attached to an actuation shaft 44*a* extending from actuator 48. Rather, arms 54*a*,56*a* form a solid unit which engages triggers 32 directly in response to retractive action of actuator 48. Preferably, the arms are provided with a guiding mechanism which may take the form of guides 53 extending along opposite sides of actuator 48 and urged thusly by a return spring 55 to bias arms 54*a*,56*a* toward the followers so that they are activated to the default position.

Figure 7:
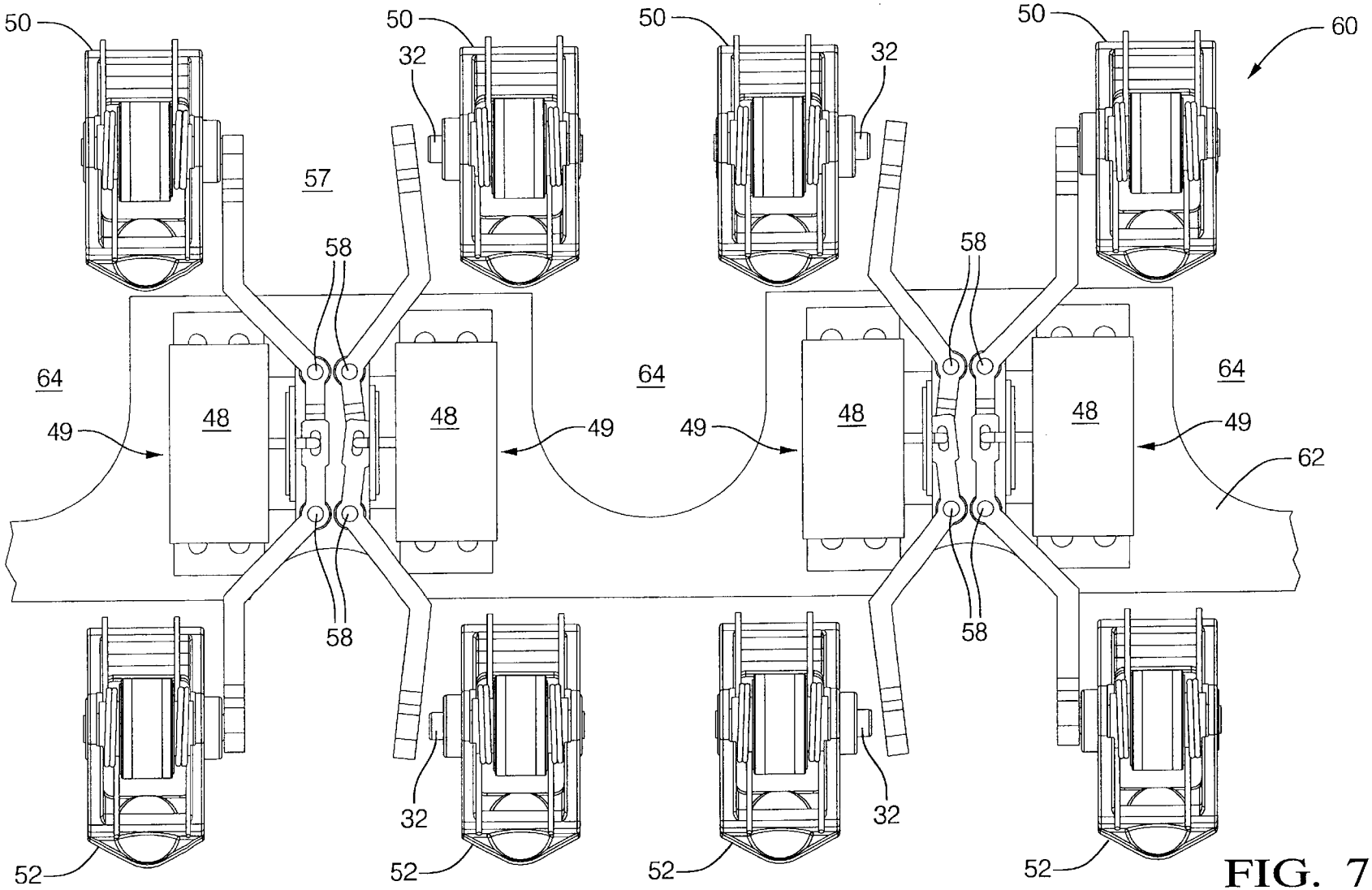
FIG. 7 is a plan view of a portion of a multi-cylinder assembly including a plurality of off-axis actuators like that shown in FIG. 6, showing roller finger followers in activated and deactivated states.
Figure 8:
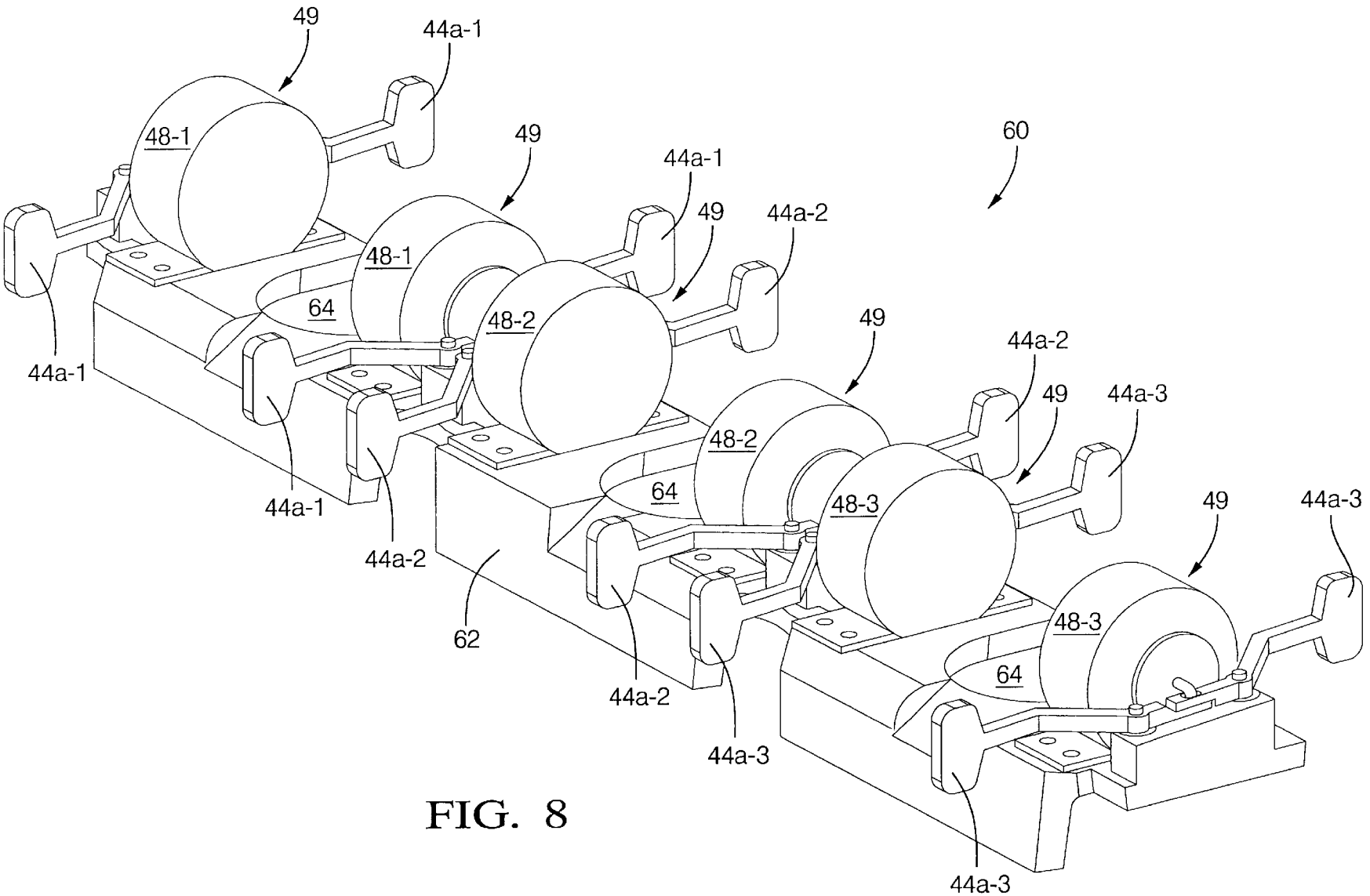
FIG. 8 is an isometric view from above of a complete assembly of off-axis actuators like that shown in FIG. 6, the assembly being configured for activation/deactivation of the roller finger followers for a three-cylinder bank of a V-6 engine.

In FIGS. 7 and 8, an assembly 60 comprising a plurality of off-axis actuator systems 49 is shown for installation onto an engine for deactivation of a plurality of cylinder valves of an internal combustion engine 57. Actuators 48 and pivot shafts 58 are fixed to a shaped baseplate 62 having, for example, openings 64 for access to spark plug towers in the engine head. Assembly 60 is configured for deactivation of four valves per cylinder of a three-cylinder head, as may be used in a V-6 style engine (not shown); that is, actuators 48-1 and actuation plates 44*a*-1 control actuation of the four valves of a first cylinder, actuators 48-2 and plates 44*a*-2 the valves of a second cylinder, and actuators 48-3 and plates 44*a*-3 the valves of a third cylinder.

It will be apparent to one of ordinary skill in the art that a valve train mode switching system including a roller finger follower, as illustrated and described herein, and many of its features, could take various forms as applied to other applications and the like. While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for selectively switching the action of a valve in an internal combustion engine, comprising:

a) a mode switching roller finger follower operationally disposable in said engine between a camshaft lobe and valve actuation means, said follower having a frame and having a roller disposable for rotation in said frame, and having means for controllably causing said roller to be alternately connected to and disconnected from said frame; and b) actuation means for directing said means for causing.

2. A system in accordance with claim 1 wherein said means for causing includes first and second axial pins, wherein in a first axial position said first and second pins engage first and second walls, respectively, of said frame and wherein in a second axial position said first and second pins are disengaged from said first and second walls.

3. A system in accordance with claim 2 wherein when said pins are in said first axial position said follower is engageable of a high lift lobe and is disengageable of a low lift lobe on a camshaft of the engine, and further wherein when said pins are in said second axial position said follower is disengageable of said high lift lobe and is engageable of said low lift lobe on said camshaft.

4. A system in accordance with claim 2 wherein said means for causing further comprises a first coil spring disposed coaxially on one of said first and second pins and operative against said frame for biasing said system toward said first position.

5. A system in accordance with claim 4 wherein said actuator further comprises a second spring more powerful than, and opposed to, said first spring.

6. A system in accordance with claim 1 wherein said actuation means is disposed coaxially of said roller and is selected from the group consisting of hydraulic actuator and solenoid actuator.

7. A system in accordance with claim 1 wherein said actuation means comprises a linear actuator disposed non-coaxially of said roller and an arm operative between said actuator and said means for causing.

8. A system in accordance with claim 7 wherein said arm is a pivot arm.

9. A system in accordance with claim 8 further comprising a second pivot arm operative between said actuator and a second deactivatable roller finger follower whereby said first and second roller finger followers may be actuated simultaneously.

10. A system in accordance with claim 9 wherein said first and second roller finger followers control the opening and closing of an intake valve and an exhaust valve, respectively, for the same engine cylinder.

11. A system for selectively switching the action of the intake and exhaust valves of a plurality of cylinders in a multi-cylinder internal combustion engine, comprising:

a) a plurality of mode switching roller finger followers each of said followers being operationally disposable in said engine between a respective camshaft lobe and a corresponding valve actuation means, and each of said followers having a frame and having a roller disposed for rotation in said frame, and having means for controllably causing said roller to be alternately connected to and disconnected from said frame; and b) a plurality of actuation means for directing said plurality of means for causing for said followers.

12. A system in accordance with claim 11 further comprising a baseplate for supporting said plurality of actuation means.

13. A multi-cylinder internal combustion engine comprising means for mode switching at least one valve for at least one of said cylinders, said means including a mode switching roller finger follower operationally disposable in said engine between a camshaft lobe and valve actuation means, said follower having a frame and having a roller disposed for rotation in said frame, and having means for controllably causing said roller to be alternately connected to and disconnected from said frame, and actuation means for directing said means for causing.

14. An engine in accordance with claim 13 wherein said mode switching is selected from the group consisting of high lift and low lift of said valve, and activation and deactivation of said valve.

* * * * *